US006027224A

United States Patent [19]

Schnell

[11] Patent Number: 6,027,224

[45] Date of Patent: Feb. 22, 2000

[54] MULTIPURPOSE POCKET ACCESSORY HAVING OPTICAL AND MECHANICAL TOOLS

[76] Inventor: Tim Schnell, 3708 Cobblestone Ct., Bedford, Tex. 76021

[21] Appl. No.: 09/133,760

[22] Filed: Aug. 12, 1998

[51] Int. Cl.[7] ..... B26B 11/00

[52] U.S. Cl. ..... 362/119; 362/184; 362/234; 362/253; 362/259; 7/168

[58] Field of Search ..... 362/109, 116, 362/119, 120, 184, 200, 205, 234, 253, 259; 7/118, 158, 161, 167, 168; 30/123

[56] References Cited

U.S. PATENT DOCUMENTS

| | | | |
|---|---|---|---|
| 4,831,504 | 5/1989 | Nishizawa et al. | 362/116 |
| 4,918,775 | 4/1990 | Leu | 362/119 |
| 5,051,876 | 9/1991 | Norman | 362/120 |
| 5,359,779 | 11/1994 | Polk et al. | 362/184 |
| 5,772,308 | 6/1998 | Lin | 362/119 |
| 5,857,268 | 1/1999 | Park | 362/119 |

*Primary Examiner*—Alan Cariaso
*Attorney, Agent, or Firm*—Schwegman, Lundberg, Woessner & Kluth P.A.

[57] ABSTRACT

A multipurpose pocket accessory includes handheld optical and mechanical implements. A laser pointer and a flashlight project separate beams from one end of an elongated housing, and have a common power supply within the housing. A set of pocketknife type tools can be extended from the other end of the housing.

38 Claims, 7 Drawing Sheets

MULTIPURPOSE POCKET ACCESSORY HAVING OPTICAL AND MECHANICAL TOOLS

BACKGROUND OF THE INVENTION

The present invention relates to compound tools, and more particularly concerns a pocketknife type of tool including optical functions as well.

Many people in different walks of life find it useful to carry with them a number of items that can be roughly classified as hand-held tools or implements, and that are small enough to fit in a pocket or handbag. Some of these items, such as pens and pocket screwdrivers, serve individual functions. A number of combinations or tool sets have evolved to allow multiple functions in a small, pocketable package that can be held in the hand while in use. Pocket knives are an excellent example. These tool sets are mechanical in nature. Knife blades, screwdrivers, fingernail files, bottle and can openers, and many similar tools have been combined more or less successfully into the pocketknife format.

Hand-held items of a different nature are finding increasing use in this format. Pocket flashlights, for example, find use in many situations, from inspecting a dark corner of a desk drawer to finding a keyhole in a car door. In fact, miniature key-ring flashlights are sold in stores for this application alone. Another item that has become available in a pen-like pocket format is the laser pointer, an instrument for projecting a thin beam of light onto a screen or other display for pointing out particular areas of an image.

These hand-held optical implements, a flashlight and a laser pointer, are useful to many of the same people. And many of these people, such as office and business workers, professionals, teachers, trades people, police and security workers, campers and hikers, also have need of one or more of the mechanical tools included in the traditional pocketknife ensemble. Yet the only available option is to purchase a number of separate, often incompatible items.

SUMMARY OF THE INVENTION

The present invention provides a hand-held pocket- or handbag-size accessory that provides mechanical tools or instruments of the pocketknife variety along with optical components such as a flashlight and laser pointer in a single package for easy portability and convenient use at any time and place. The package permits each of these functionally diverse types of implement to function well in an unexpectedly small, robust, and esthetically pleasing form factor.

A multipurpose pocket accessory according to the invention is constructed in an elongated housing or shell that fits comfortably in a hand. An optical pointer and a flashlight project separate beams from one end of the housing, along its long axis. Both use a common internal power supply, to decrease the bulk of the total package. The mechanical pocketknife tools are positioned along the housing axis at its other end, and can be selectively extended out of the housing for individual use without interfering with the optical functions. This placement of the various components also gives a pleasing feel or heft to the accessory, both for the optical functions and the mechanical functions, and is highly compatible with the types of batteries or other power devices easily and inexpensively available for optical pointers and flashlights.

DETAILED DESCRIPTION

The following description presents several preferred embodiments of the present invention in sufficient detail that those skilled in the art can make and use the invention. Variations within the concepts of the invention will suggest themselves to those in the art, as will additional features and advantages. The description, therefore, is illustrative only, and the scope of the invention is determined only by the appended claims.

Figure 1:
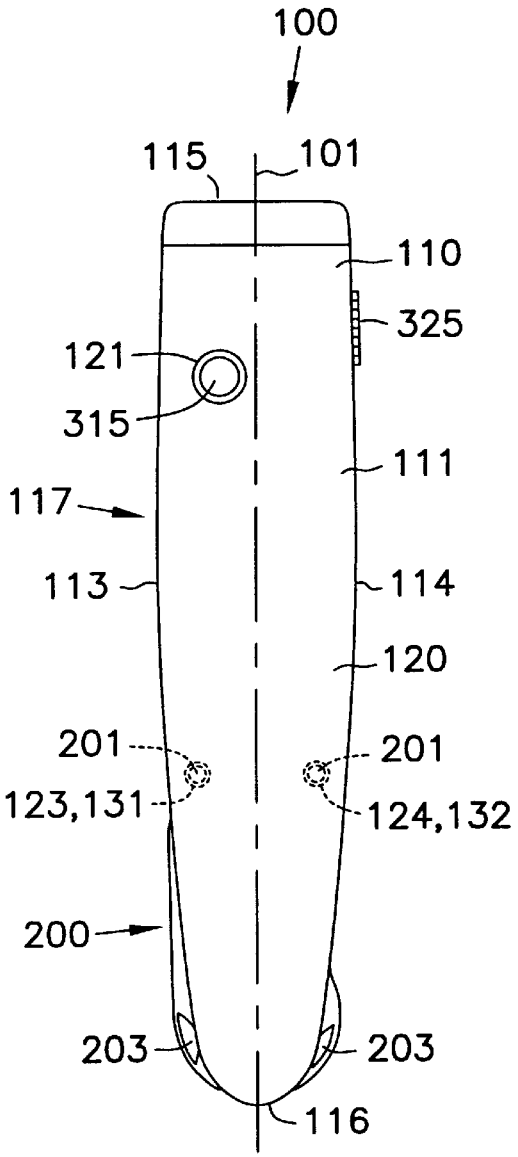
FIG. 1 is a top view of a pocket accessory embodying the invention.
Figure 3:
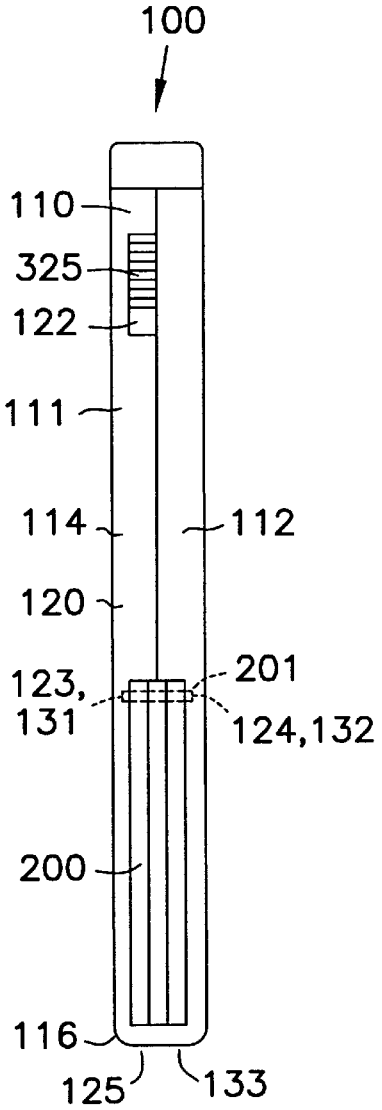
FIG. 3 is a side view of the accessory of FIG. 1.
Figure 2:
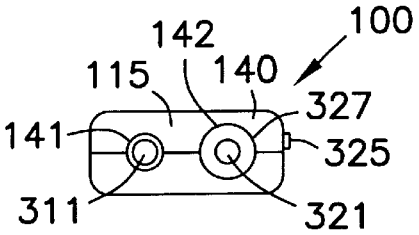
FIG. 2 is an end view of the accessory of FIG. 1.

FIGS. 1–3 show a pocket accessory 100 according to the invention. An elongated housing or cover 110 has a long axis 101. Its cross section is roughly a parallopiped, having substantially flat top and bottom surfaces 111 and 112 with radiused corners, and a slightly bowed or arcuate sides 113 and 114. Sides 113 and 114 curve inwardly slightly at a flat front end 115, and somewhat more at rounded rear end 116. The overall size of housing 110 is about as large as or slightly larger than a pocketknife and sized to fit comfortably in the hand and in a pocket or small handbag. That is, it has an outside size in the range of about 3 to 5 inches long, about 1¾ to ½ inches wide at its widest point, and about ½ to ¾ inch thick, from top 111 to bottom 112. As seen more clearly in FIG. 2, the corners of the housing are slightly rounded, both for comfort in the hand and for slipping into or out of a pocket or purse more easily.

Housing 110 is constructed of upper and lower halves 120 and 130, FIGS. 2 and 3 End cap 140 forms the front end of housing 110. These components can be made of metals such as steel, aluminum, or brass, of plastic such as PVC, rubberized material, wood, or of various combinations of these or other materials. The flat front surface 115 of housing end cap 140 has two round apertures 141 and 142. Upper housing half 120 has a round aperture 121 and a rectangular aperture 122, both near front end of the housing and about equidistant therefrom. Dotted lines 123, 124 and 131, 132 in FIGS. 1 and 3 indicate depressions formed in the insides of both the upper and lower housing halves 120 and 130 in the rear portion 116 of the housing 110 near the center. The rear portions of the halves 120 and 130 have longitudinal slots 125 and 133.

Figure 4:
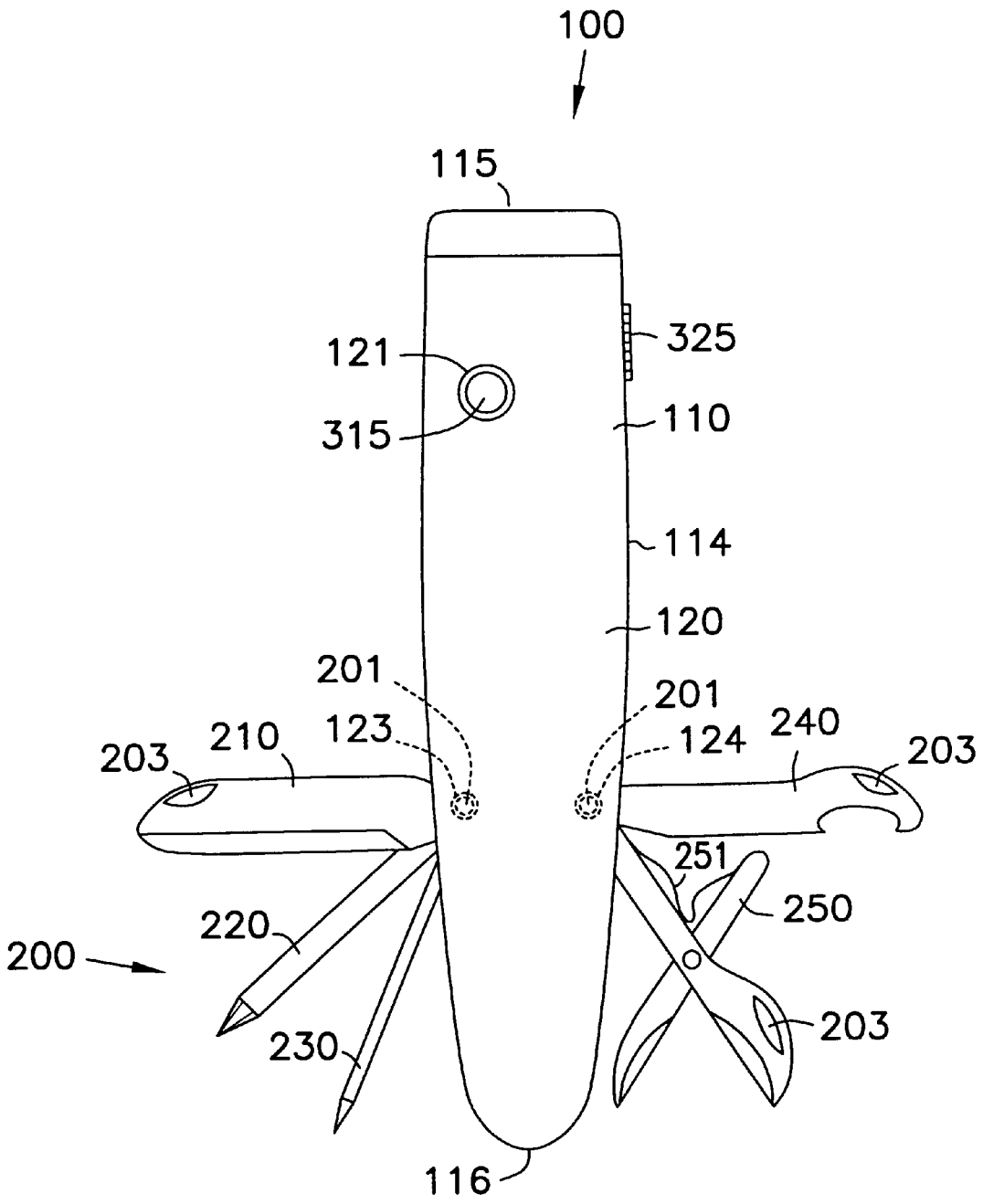
FIG. 4 shows the accessory of FIG. 1 with the tool set extended.

A set 200 of mechanical pocketknife-type tools are swingably mounted on vertical posts 201 and 202 fixed into apertures 123, 124 131, and 132 in the housing halves. FIG. 1 shows tools 200 in their closed positions, in which they extend outside housing 110 enough to be grasped and individually swung out of the housing for use, as shown in FIG. 4. Conventional indentations such as 203 aid in pulling the tools out. A representative set of tools 200 includes a short knife blade 210, as screwdriver 220, a pick 230, a bottle opener 240, and a small scissors 250 having a spring 251 for holding its blades apart. In use, of course only one of the tools 210–250 would be swung outside the housing 110 at once. More or fewer tools can be included, and other conventional tools, such as a file, pliers, a magnifying glass, or a pen, can be substituted for those shown.

Figure 5:
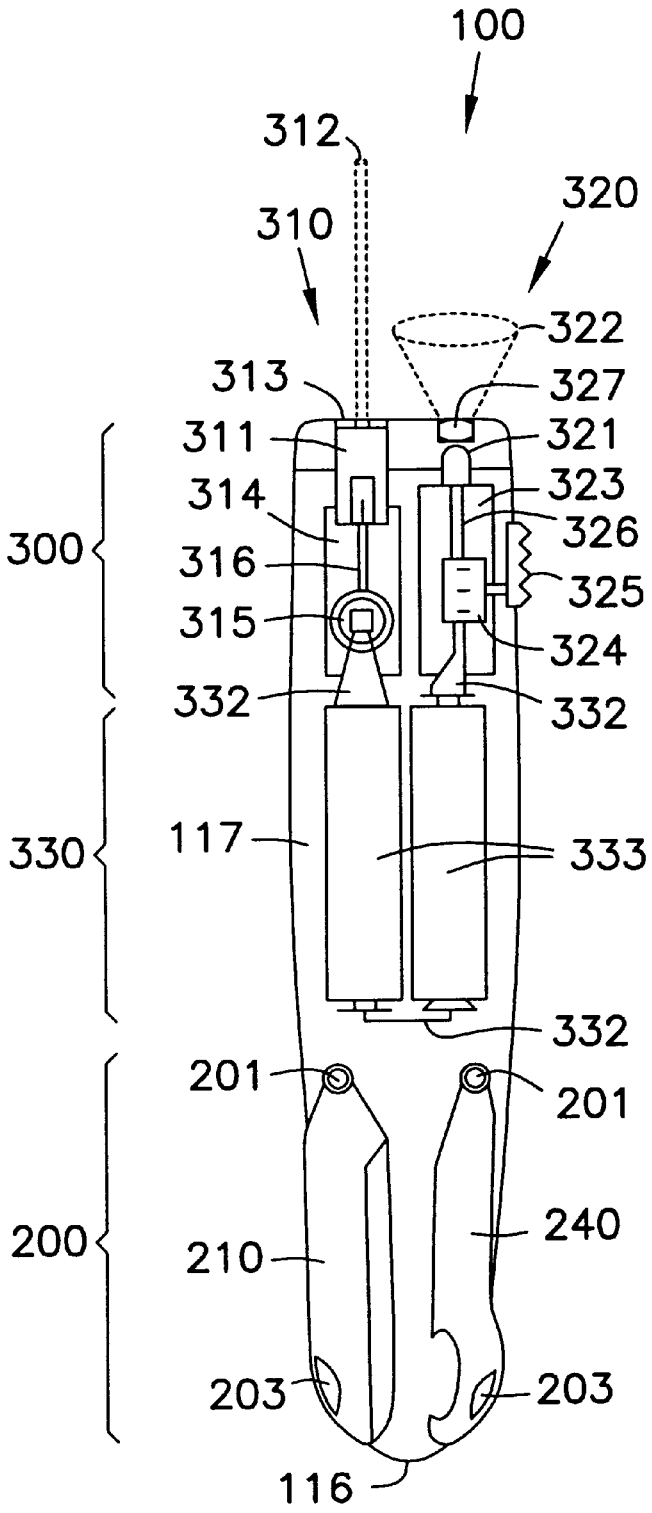
FIG. 5 shows the interior of the accessory of FIG. 1.

FIG. 5 is an interior view of accessory 100, with upper housing half 120 removed to show a set of optical components 300 in the front portion of housing 110.

Optical pointer assembly 310 includes a semiconductor laser, light-emitting diode, or similar optical output device 311 that projects a narrow beam, indicated by dashed lines 312, through housing aperture 141 for a distance of ten to thirty feet or more to form a spot on a screen (not shown) or other surface. The spot should be relatively small, less than about an inch or two in diameter when it hits the screen. The spot is typically red, although any color can be used. The spot can be solid, or may have a design imposed on it by a mask 313. Optical device 311 is mounted on a small longitudinally extending circuit board or similar carrier 314 that also mounts a spring-return momentary push-button switch 315 that projects through aperture 121 in housing 110, FIG. 1. Wiring 316 on carrier 312 electrically connects device 311 and switch 315 to a power supply 330 so that device 311 projects beam 311 when switch 315 is depressed.

Flashlight assembly 320 includes a grain-of-wheat or other small electrical bulb 321, or other optical output device that projects an optical beam 322 through aperture 142 in end cap 140. Flashlight beam 322 is much wider than pointer beam 312; beam 322 is designed to illuminate objects much closer than pointer beam 312, and may have an angle of about 15° to 90° or more, as compared to less than 0.3° for beam 312. Optical output device 321 is mounted on another small longitudinal carrier 323 that also mounts (or has integrally formed therein) a slide switch 324 having a rectangular actuator 325 that extends through aperture 122 in housing 110. A slide switch is one possible type of locking or detent switch that remains in its current position when pressure is released. Actuator 325 moves back and forth along the long axis of housing 110 for easy finger control. Wiring 326 electrically connects bulb 321 and switch 324 to power supply 330. A small molded-plastic lens 327 can further focus flashlight beam 322, if desired.

Power supply 330 in this embodiment is a battery carrier 331 having wiring and/or contacts 332 for internal and external connections to both of the optical assemblies 310 and 320. Two series-connected AA or AAA size cells 333 provide a convenient voltage and power for operating either of the assemblies; normally, of course, only one of them will be energized at any one time. These and similar cell types are available universally at a low cost, especially as compared to button, coin, or other specialty cells. Power supply 330 occupies a middle portion 117 of housing 110. Placing this heavy component in the middle rather than at or near either end has the advantage of better balance or heft in the hand. Also, the midportion 117 is wider than either end, providing a larger volume for one or more batteries mounted longitudinally inside the housing. Other sizes and numbers of batteries can also be accommodated for higher power or longer life; four cells is a common number in similar applications.

Although FIG. 5 shows carriers 314, 323, and 331 as physically separate pieces, two or all three of them can be formed of a single piece of plastic or other insulating material.

Figure 6:
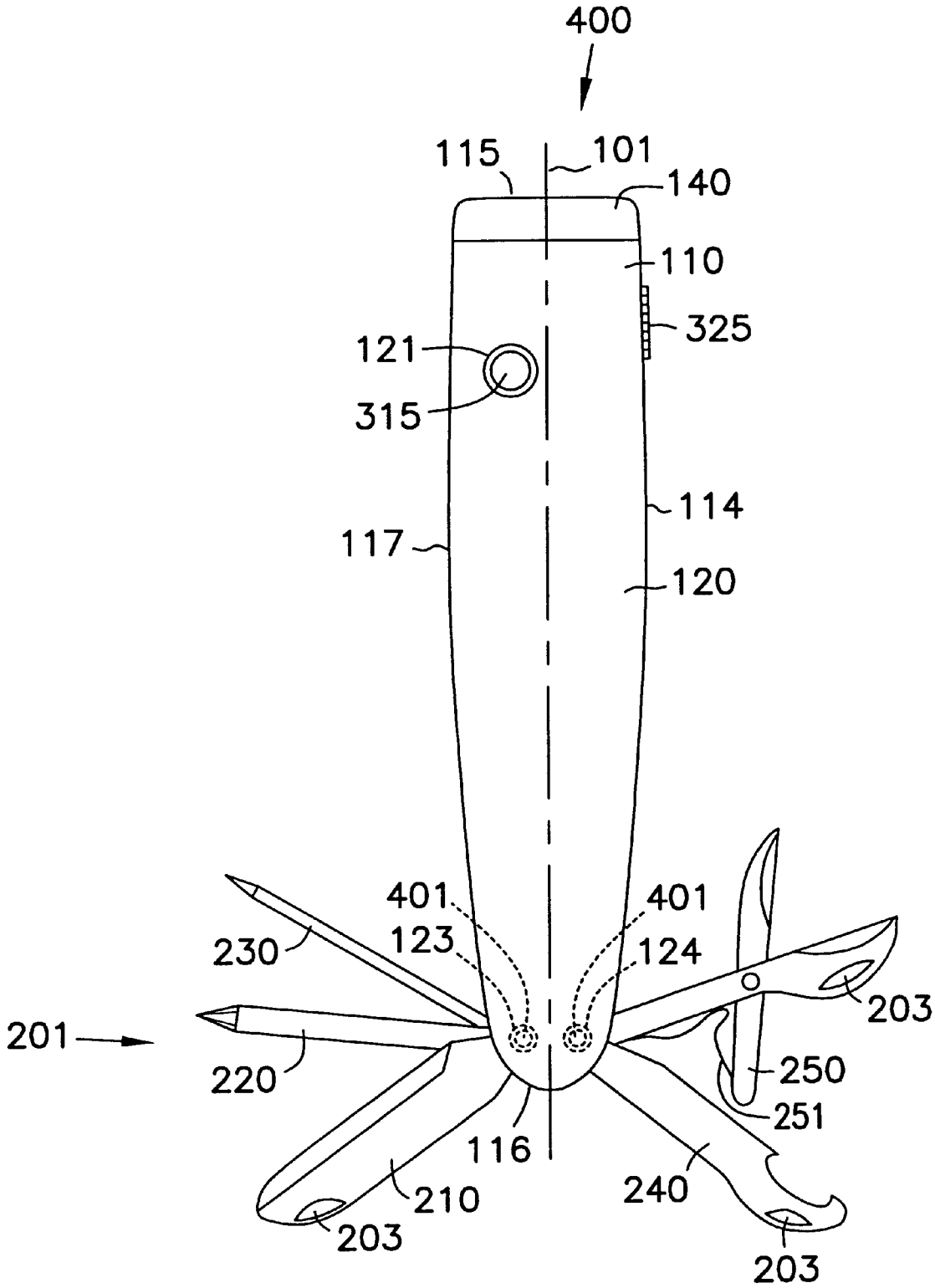
FIG. 6 is a top view of an alternative pocket accessory embodying the invention.
Figure 7:
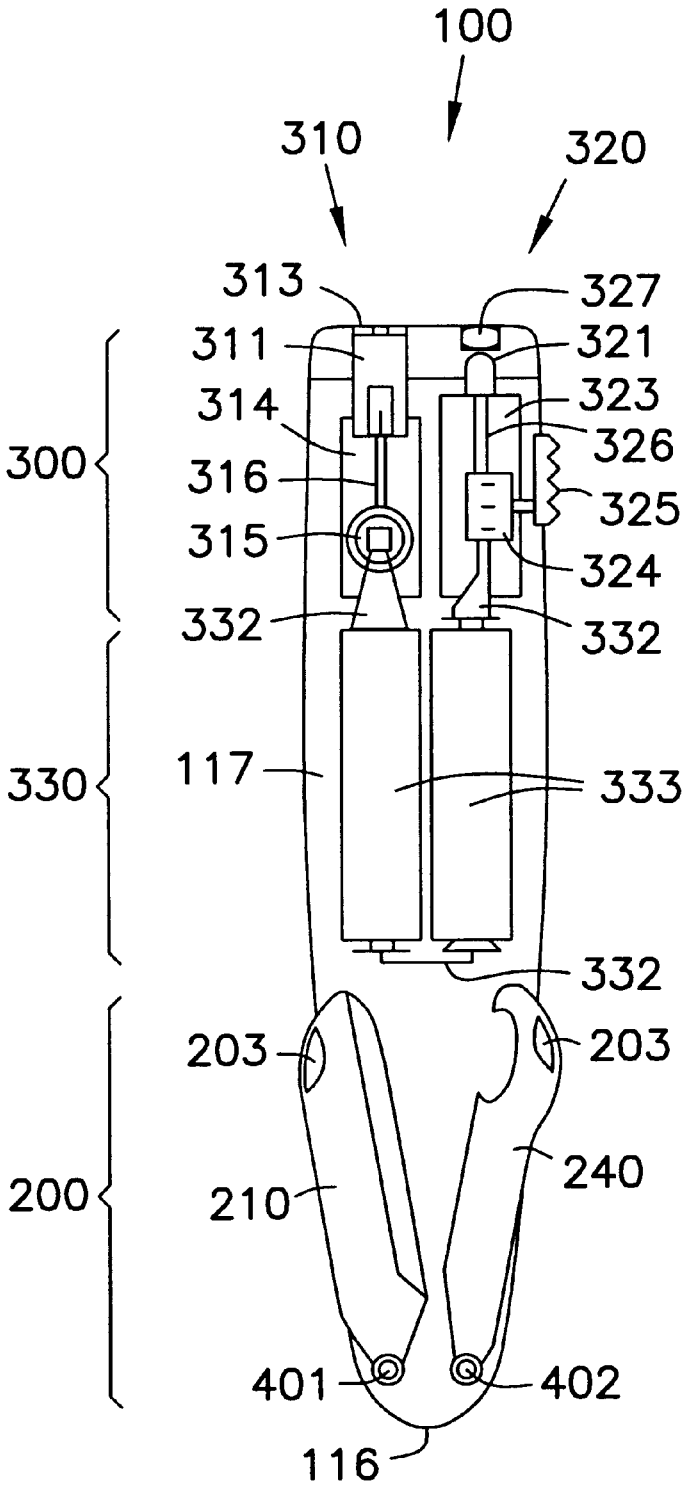
FIG. 7 shows the interior of the accessory of FIG. 6.

FIGS. 6 and 7 show another embodiment 400 of pocket accessory 100. In this version, tools 200 are swivelled near the rear end 116, so that they can extend longitudinally beyond the body of accessory 100, that is, beyond housing 110, for greater ease of use. FIG. 6 shows the same set of tools 210–250, only partially extended. FIG. 7 is an interior view showing the tools 210–250 folded into the same type of housing slots as 125 and 133, FIG. 1. This embodiment also shows mounting posts 401 and 402 that do not extend all the way through housing halves 120 and 130. For better cosmetic appearance, these posts can be affixed to the inner surfaces of the halves or to depressions (not shown) therein, by any conventional means. Optical components 300 are positioned as in FIGS. 1–5.

Figure 8:
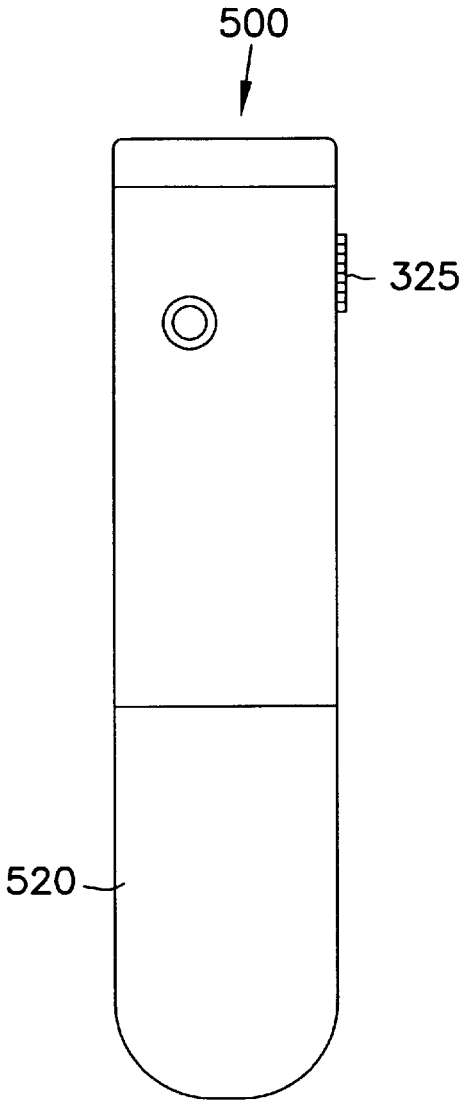
FIG. 8 is a top view of another pocket accessory embodying the invention.
Figure 10:
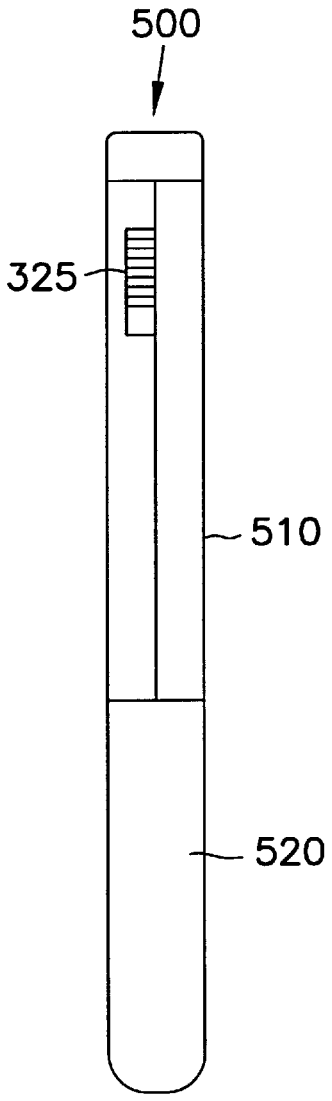
FIG. 10 is a side view of the accessory of FIG. 8.
Figure 9:
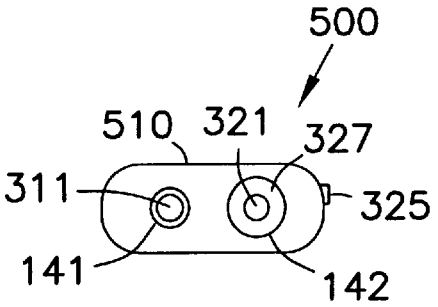
FIG. 9 is an end view of the accessory of FIG. 8.

FIGS. 8–10 show a further embodiment 500 of pocket accessory 100. Housing 510 has an exterior shape that is more rectangular in profile, and has an oval or obround cross section, as shown in FIG. 9. A sheath or cover 520 frictionally engages the middle portion of housing 510, and can be removed by sliding it in the direction of arrow 521. The rear end of cover 520 is rounded both from side to side and from top to bottom. Tool set 200 mounted beneath cover 520 can have the same general outline as the cover, or can assume the dispositions shown in FIGS. 1–5 or in FIGS. 6–7. Cover 520 avoids catching tools 200 on clothing or another container, and can also provide a decorative aspect.

Figure 11:
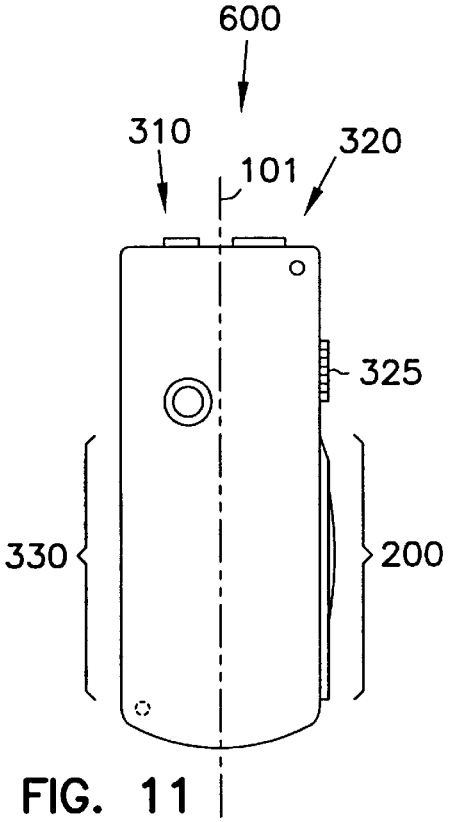
FIG. 11 is a top view of a further pocket accessory embodying the invention.
Figure 12:
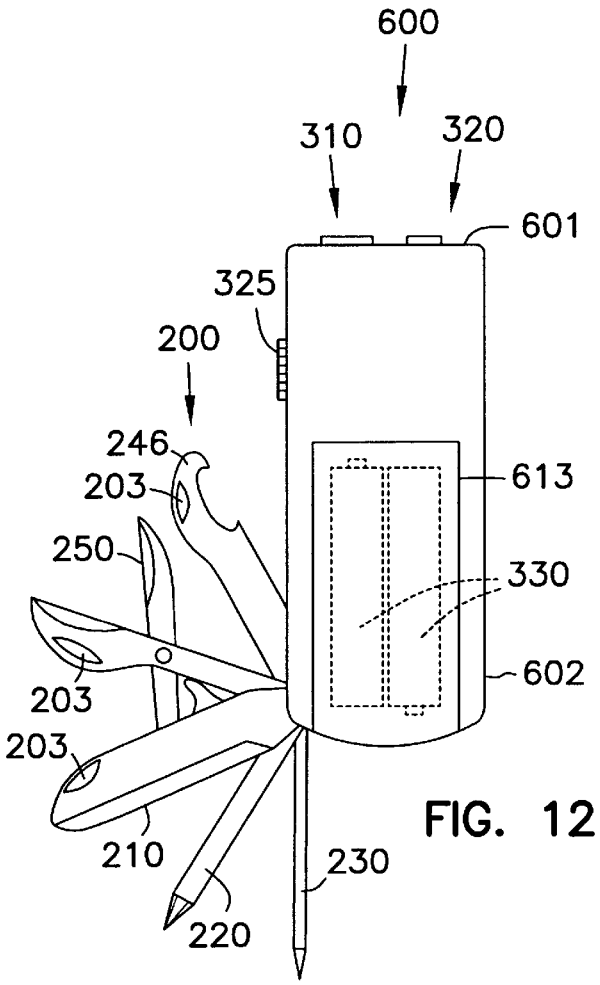
FIG. 12 is a bottom view of the accessory of FIG. 11.
Figure 13:
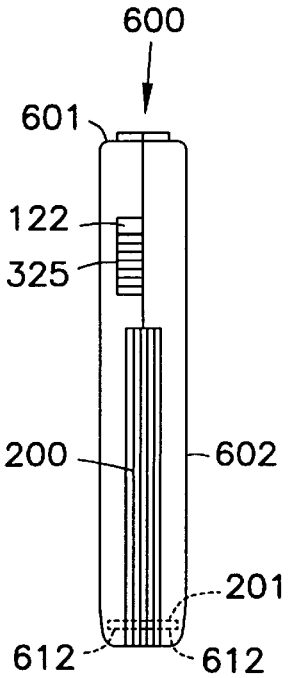
FIG. 13 is a side view of the accessory of FIG. 11.
Figure 14:
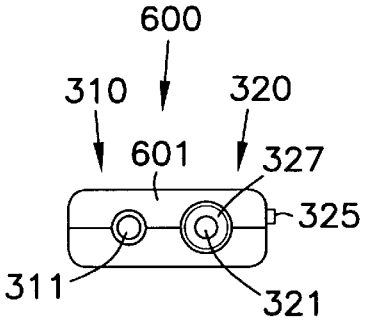
FIG. 14 is an end view of the accessory of FIG. 11.

FIGS. 11–14 show a further embodiment 600 of the invention. Two-piece molded-plastic housing 610 is held together with small screws, press pins, adhesive, and/or any other suitable means. FIG. 11 indicates the positions of two small self-tapping screws 611 as representative fastening means. The outside dimensions of housing 610 are about 3½ inches long by 1¼ inches wide across the top and bottom surfaces by ½ inch thick across the side surfaces. These four surfaces are substantially flat, with radiused corners, as seen in the end view of FIG. 14. The size and shape of housing 610 makes accessory 600 easy to hold in the hand and sufficiently compact to store in even a small pocket or purse. Pointer assembly 310 and flashlight assembly 320 are mounted side by side near front end 601, in the same positions as shown in FIGS. 5 and 7. This wider, shorter version has a single tool set 200 mounted in a slot in the rear portion 602 beside power supply 330, instead of behind it. Such a configuration also lends a desirable balance or feel to the accessory, because the weight is centered behind the lighter optical elements, allowing the front end 601 to be swung easily with little effort to direct the pointer and flashlight beams. Individual tools 210–250 are about 2 inches or less in length in this version, although larger ones, up to the full length of accessory 600, could be accommodated on the other side (the left side in FIG. 11) of accessory 600 without substantially increasing its overall size. Likewise, gripping the rearward portion 602 of accessory 600 gives a solid, balanced feel while manipulating the tools 200, because of the nearby weight of the batteries.

Tools 200 are swingably mounted on metal pin 201 captured in housing depressions indicated at 612. A conventional slidable panel 613 covers longitudinally disposed batteries 333, indicated here by dashed lines. Panel 613 slides rearward to change batteries 333, and detents in place when slid forward. Two AAA-size batteries are shown; other sizes can be accommodated, and a longer or thicker version could receive four batteries, or any other desired number.

Those skilled in the art will recognize other variations within the scope of the invention. For example, all of the tools 200 can be mounted on one side of housing 110, e.g., on a single one of the posts 201, 202, 401, or 402,. Some or all of the tools could extend lengthwise from the rear end of housing 110, through a suitable opening. The carriers 314 and 323 can be physically integrated with each other in a single plastic or other piece, and these can be integrated with power supply carrier 331. The power supply can be other than removable dry-cell batteries. For example, rechargeable cells might have external contacts (not shown) on housing 100 for recharging from an external source. In some cases, a solar-cell based supply might be feasible.

Having described several illustrative embodiments thereof and a few of the variations thereof, I claim as my invention:

1. A multipurpose pocket accessory comprising:

an elongated housing having a long axis and having an overall size sufficiently small to fit comfortably in a hand of a user;

an optical pointer assembly disposed within the housing for projecting a thin optical beam from one end of the housing along the long axis of the housing and including a pointer switch;

a flashlight assembly disposed within the housing for projecting a wide optical beam from the one end along the long axis of the housing and including a flashlight switch;

a common power supply for both the optical pointer and the flashlight assemblies disposed within the housing; and a set of mechanical tools mounted within the housing so as to be selectively extendible outside the housing while remaining affixed to the housing.

2. The multipurpose pocket accessory of claim 1, wherein the housing measures about three to about five inches along its long axis.

3. The multipurpose pocket accessory of claim 2, wherein the housing is substantially parallelopiped.

4. The multipurpose pocket accessory of claim 1, wherein the housing includes an end surface substantially perpendicular to the long axis and having a first aperture for projecting the thin optical beam and has a second aperture for projecting the wide optical beam.

5. The multipurpose pocket accessory of claim 4, wherein the pointer switch is a momentary switch.

6. The multipurpose pocket accessory of claim 5, wherein the pointer switch projects through the housing near the end surface.

7. The multipurpose pocket accessory of claim 6, wherein the housing has a top and a bottom surface, and wherein the pointer switch is located on one of the top and bottom surfaces.

8. The multipurpose pocket accessory of claim 4, wherein the flashlight switch is a locking switch.

9. The multipurpose pocket accessory of claim 8, wherein the flashlight switch projects through the housing near the end surface.

10. The multipurpose pocket accessory of claim 9, wherein housing includes two side surfaces extending along the long axis, and wherein the flashlight switch is located on one of the side surfaces.

11. The multipurpose pocket accessory of claim 1, wherein the power supply is a battery holder electrically coupled to the optical pointer and flashlight assemblies.

12. The multipurpose pocket accessory of claim 11, wherein the battery holder is configured to hold one or more electrical cells disposed parallel to the long axis of the housing.

13. The multipurpose pocket accessory of claim 1, wherein the set of mechanical tools includes a knife.

14. The multipurpose pocket accessory of claim 13, wherein the set of tools includes a screwdriver.

15. The multipurpose pocket accessory of claim 13, wherein the set of mechanical tools includes an opener for a container.

16. The multipurpose pocket accessory of claim 1, wherein the housing includes a mounting for extending individual ones of the tools of the set outside the housing.

17. The multipurpose pocket accessory of claim 16, wherein the mounting is adapted for swingably extending individual ones of the tools.

18. The multipurpose pocket accessory of claim 16, wherein the housing includes a slot encasing the tools of the set.

19. A multipurpose pocket accessory comprising:

an elongated housing in the shape of a parallelopiped having an overall size sufficiently small to fit comfortably in a hand of a user, the housing having wide top and bottom surfaces and narrower side surfaces along a long axis, and having a front end surface transverse to the long axis and a rear portion opposite the front end;

an optical pointer assembly disposed within the housing near the front end surface, for projecting a thin optical beam from the front end surface along the long axis of the housing;

a flashlight assembly disposed within the housing near the front end surface, for projecting a wide optical beam from the one end along the long axis of the housing;

a power supply disposed within the rear portion of the housing, for holding at least one electrical cell for powering both the optical pointer and the flashlight assemblies; and a set of mechanical tools mounted in the rear portion of the housing so as to be selectively extendible outside the housing while remaining affixed to the housing.

20. The multipurpose pocket accessory of claim 19, wherein the top and bottom surfaces of the housing are substantially flat.

21. The multipurpose pocket accessory of claim 20, wherein the side surfaces are substantailly flat, with radiused corners.

22. The multipurpose pocket accessory of claim 19, wherein the housing further includes a panel over the power supply for exposing the at least one electrical cell.

23. The multipurpose pocket accessory of claim 22, wherein the power supply is adapted to hold multiple cylindrical electrical cells disposed along the long axis of the housing.

24. The multipurpose pocket accessory of claim 19, wherein the housing includes a slot formed beside the power supply for encasing the set of mechanical tools.

25. The multipurpose pocket accessory of claim 24, wherein the set of mecahnical tools are mounted for swingable extension outside the housing.

26. The multipurpose pocket accessory of claim 25, wherein the mechanical tools are mounted for swingable extension away from the front end of the housing.

27. The multipurpose pocket accessory of claim 19, wherein the pointer assembly includes a momentary switch projecting through one of the top and bottom surfaces of the housing near the front end surface.

28. The multipurpose pocket accessory of claim 19, wherein the flashlight assembly includes a locking switch projecting through one of the side surfaces of the housing near the front end surface.

29. The multipurpose pocket accessory of claim 28, wherein the locking switch is a slide switch moving in the direction of the housing's long axis.

30. A multipurpose pocket accessory comprising:

an elongated housing in the shape of a parallelopiped having an overall size sufficiently small to fit comfortably in a hand of a user, the housing having top and bottom surfaces and narrower side surfaces along a long axis, and having a front end surface transverse to the long axis and a rear portion opposite the front end;

an optical pointer assembly disposed within the housing near the front end surface, for projecting a thin optical beam from the front end surface along the long axis of the housing;

a flashlight assembly disposed within the housing near the front end surface, for projecting a wide optical beam from the one end along the long axis of the housing;

a power supply disposed between the front end surface and the rear portion of the housing, for holding at least one electrical cell for powering both the optical pointer and the flashlight assemblies; and at least one set of mechanical tools mounted in the rear portion of the housing so as to be selectively extendible outside the housing while remaining affixed to the housing.

31. The multipurpose pocket accessory of claim 30, wherein the housing is slightly bowed at its middle for a comfortable hand grip.

32. The multipurpose pocket accessory of claim 30, wherein the set of tools is mounted for swingable extension away from the housing.

33. The multipurpose pocket accessory of claim 32, wherein the tools of the set are swingable away from the front surface of the housing.

34. The multipurpose pocket accessory of claim 32, wherein the tools of the set are swingable toward the front surface of the housing.

35. The multipurpose pocket accessory of claim 32, wherein the tools of the set are mounted on both sides of the housing.

36. The multipurpose pocket accessory of claim 30, wherein the power supply is adapted for holding at least one cylindrical electrical cell along the long axis of the housing.

37. The multipurpose pocket accessory of claim 36, wherein the power supply is adpated for hoding multiple electrical cells side by side.

38. The multipurpose pocket accessory of claim 30, further including a cover for engaging the rear portion of the housing for covering the set of mechanical tools.

* * * * *